US005452712A

United States Patent [19]

Richardson

[11] Patent Number: 5,452,712

[45] Date of Patent: Sep. 26, 1995

[54] DISPOSABLE SMOKE HOOD WITH MASK AND DUAL STRAP ARRANGEMENT

[76] Inventor: James M. Richardson, 5616 N. Kings Hwy., Myrtle Beach, S.C. 29577

[21] Appl. No.: 372,347

[22] Filed: Jan. 13, 1995

[51] Int. Cl.[6] ..... A62B 19/00; A62B 23/02; A62B 17/04

[52] U.S. Cl. ..... 128/201.25; 128/205.29; 128/201.22; 128/201.28; 2/173

[58] Field of Search ..... 128/205.27, 205.28, 128/205.29, 206.12, 206.15, 206.17, 206.21, 206.28, 201.22, 201.23, 201.25, 201.28; 2/9, 173, 424

[56] References Cited

U.S. PATENT DOCUMENTS

| | | | |
|---|---|---|---|
| 1,200,528 | 10/1916 | Ryder | 2/173 X |
| 1,443,820 | 1/1923 | Hudson | 128/205.29 |
| 1,800,051 | 4/1931 | Blanco | 128/201.25 X |
| 1,856,879 | 5/1932 | Lufkin | 2/173 X |
| 2,295,279 | 9/1942 | Andrews | 2/424 X |
| 3,058,463 | 10/1962 | Goodrich | 128/201.23 |
| 3,315,674 | 4/1967 | Bloom et al. | 128/206.12 X |
| 4,141,703 | 2/1979 | Mulchi | 128/206.15 X |
| 4,231,118 | 11/1980 | Nakagawa | 128/201.25 |
| 4,382,440 | 5/1983 | Kapp et al. | 128/201.25 |
| 4,537,748 | 8/1985 | Billet | 128/202.22 X |
| 5,038,768 | 8/1991 | McGoff et al. | 128/202.26 |
| 5,058,578 | 10/1991 | Weiss | 128/205.27 |
| 5,115,804 | 5/1992 | Brookman | 128/201.22 |
| 5,237,986 | 8/1993 | Seppala et al. | 128/201.23 |
| 5,328,758 | 7/1994 | Markell et al. | 428/281 |

FOREIGN PATENT DOCUMENTS

| | | | |
|---|---|---|---|
| 20673 | of 1904 | United Kingdom | 128/206.28 |

*Primary Examiner*—Kimberly L. Asher
*Assistant Examiner*—Eric P. Raciti
*Attorney, Agent, or Firm*—Rhodes, Coats & Bennett

[57] ABSTRACT

The present invention relates to a disposable smoke mask that is designed to be pulled over the head of a person. The disposable smoke mask includes a cooperating elastic forehead strap and a wrap-around elastic strap. The forehead strap can be pulled down so as to extend under the chin of a person wearing the smoke mask. To securely seal the mask about the head, the wrap-around strap is stretched and extended around the back of the neck area and underneath the chin of the wearer and then the wrap-around strap is extended along one side of the face area of the mask where it is secured in place. In the end, the forehead strap and the wrap-around strap cooperate to seal the mask around the face of the person wearing the same. Formed in the front of the smoke mask is a multi-stage filter, a one-way check valve, and a see through vinyl panel.

17 Claims, 5 Drawing Sheets

DISPOSABLE SMOKE HOOD WITH MASK AND DUAL STRAP ARRANGEMENT

FIELD OF THE INVENTION

The present invention is related generally to smoke masks, and more particularly to disposable smoke masks fittable over a person's head.

BACKGROUND OF THE INVENTION

The primary danger to a person located in a burning house or other building is smoke inhalation. Smoke given off from a fire can quickly engulf the air within a burning building. Persons in high-rise office and apartment buildings are particularly susceptible to the dangers of smoke inhalation. Due to the length of time often required to exit such a building, the probability of being overcome by smoke is more likely.

To prevent smoke inhalation and to provide people trapped in a burning building a chance to exit the building, smoke masks must be provided. Smoke masks filter the smoky, contaminated air and allow a person sufficient time to exit the building. Each person in a building, particularly those persons located in areas that require additional time to exit the building, should have a smoke mask at their disposal in case of fire. In order for it to be economically feasible to supply a gas mask for each person located in a building, the gas mask should be disposable and relatively inexpensive.

Disposable gas mask intended for general use by a person who may be trapped in a burning building are known and have been commercially available. Typically, prior art disposable gas masks have a rubber-type main body that forms a hood sized to fit over the head. The mask must be stretched and pulled over the user's head so that the mask clings to the user's face and head. The mask is designed to cling about the person's head to prevent contaminated air from passing by the gas mask and exposing the wearer to the contaminated air. A filter for filtering the smoky, contaminated air is typically located on a front portion of the gas mask and provides an uncontaminated or clean supply of air to the wearer.

There are several problems with prior art disposable gas masks. One primary problem is that the gas mask must be stretched to fit over the head of a wearer and then clings to the head and face of the wearer. Many users have a natural apprehension about pulling such a tight-fitting mask over their heads and about their face. In addition, such a mask is uncomfortable and difficult to position on the person's head. In addition, it is very difficult for a person to pull this type of smoke mask over his or her face when that person wears prescription glasses. For a person wearing prescription glasses, the requirement of pulling such a smoke mask over his or her head can only increase the natural apprehension. Finally, the very nature of the stretchable, skin-tight smoke mask of the prior art does not lend itself to creating an effective seal for a wide variety of people having various size heads.

The filters used on prior art disposable gas masks also have problems. The filters of the prior art are not very effective at removing all of the contaminants, especially gas, from the smoky air and also only protect the user from the contaminated air for a limited period of time. Filters of the prior art typically include an outer particulate layer and an activated carbon layer. The particulate layer removes particulate matter from the contaminated air while the carbon layer absorbs gaseous contaminants from the contaminated air. Generally, the carbon-activated layer is formed from a carbon-saturated material. Carbon-saturated filter material is typically effective for only a relatively short time when in use. Thus, filters used in prior smoke masks are not really designed for longevity.

SUMMARY AND OBJECTS OF THE INVENTION

The present invention is an improved disposable smoke mask and overcomes the above-discussed problems. The smoke mask of the present invention includes a main body or hood sized to loosely fit over and encompass the head of a wearer. The hood includes a front portion extending from the forehead of the wearer to below the chin of the wearer so as to cover substantially all of the face of the wearer. A transparent visor and a three-stage filter pack are formed in the front portion of the mask.

To seal the mask about the wearer's face, an elastic band is used. The elastic band is secured to opposite sides of the mask and normally assumes an unattached position where the strap extends across the area of the mask overlying the forehead of the wearer. The wearer places the mask in a sealed position by pulling the elastic strap downwardly and under the chin. The elastic strap in the attached position forms a seal extending along opposite sides of the front portion of the mask and under the chin of the wearer. The elastic band also pulls the main body of the mask downwardly such that a seal is formed by the mask between the opposed ends of the elastic strap such that the face of the wearer is completely sealed. The elastic band accordingly seals the mask so that contaminated air is drawn through the filter and removed of impurities to produce a safe and clean air supply for the wearer to breath.

The filter of the mask includes three layers or stages for removing contaminants from the contaminated air. The first or outer layer is a particulate filter that removes particulates from the contaminated air. The inner or final layer is an activate carbon layer that absorbs harmful gases from the contaminated air. The activated carbon layer is formed by a solid bed of carbon. The solid bed of carbon is effective in removing gases from the contaminated air for an extended period of time. An intermediate carbon monoxide catalyst layer is also provided for converting carbon monoxide to carbon dioxide.

Also disclosed herein is a second embodiment for the smoke mask of the present invention. In the second embodiment, there is shown a multi-stage filter pack assembly that includes four separate and distinct filter layers. Here, the filter pack includes a particulate filter layer, an activated carbon filter layer, a desiccant filter layer, and a carbon monoxide catalyst filter layer. This filter pack arrangement provides for a very effective filter for removing harmful and dangerous contaminants from smoke and contaminated air, especially in the case of a fire.

The second embodiment also includes a cooperating strap arrangement that provides for an effective seal around the face of a person wearing the smoke mask of the present invention. A dual strap arrangement is utilized in the second embodiment. This comprises a forehead or chin strap that pulls down and stretches and is engaged under the chin and extends up along opposite sides of the face. In addition, there is provided a wrap-around strap anchored on one side at a bottom portion of the mask. The wraparound strap wraps around behind the neck of the subject, around the opposite side of the neck, underneath the chin, and then extends back up the opposite side of the face where the wrap-around strap attaches to the smoke mask structure. This effectively seals around the face and the neck and provides a seal structure for protecting the person wearing the smoke mask of the present invention.

Accordingly, it is an object of the present invention to provide a disposable and inexpensive gas mask.

Another object of the present invention is to provide a gas mask that is comfortable when worn.

Another object of the present invention is to provide a gas mask that removes contaminates from contaminated air for an extended period of time.

Another object of the present invention is to provide a gas mask that is easily fitted over a person's head even if prescription glass are worn.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 2:
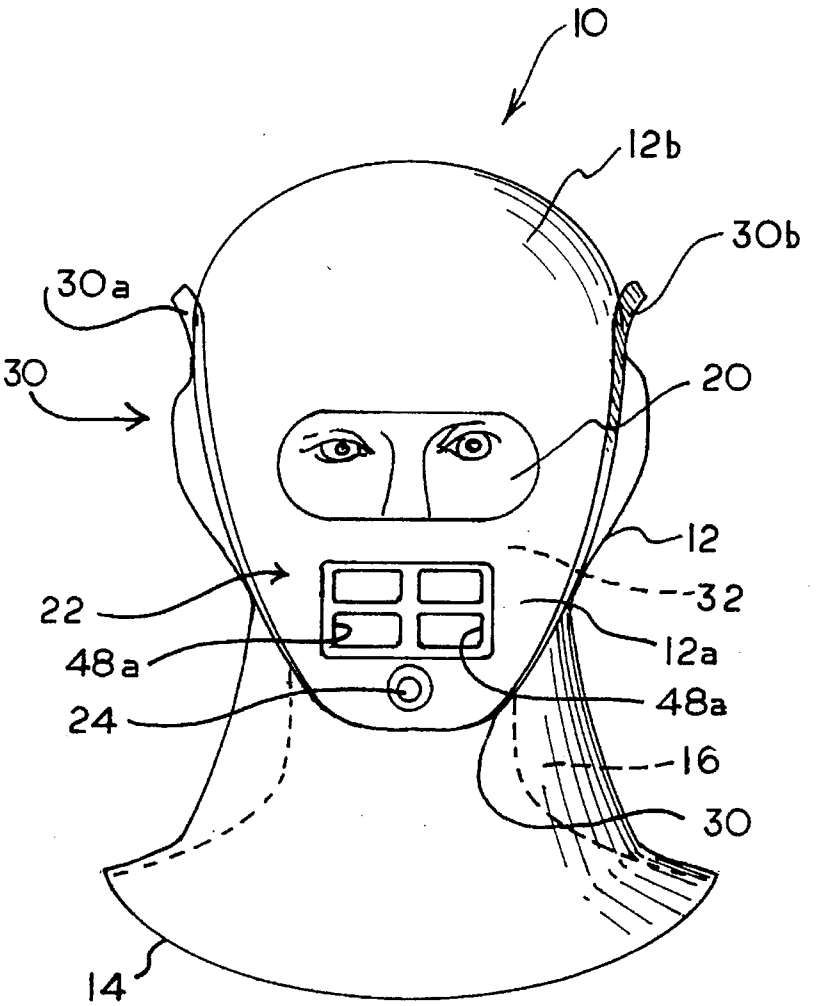
FIG. 2 is a front elevational view of the smoke mask of the present invention with the chin strap pulled downwardly around the chin of an individual so as to form a seal around the person's head wearing the mask.

With reference to the drawings, the smoke mask of the present invention is shown therein and indicated generally by the numeral 10. Smoke mask 10 is used to protect a person from smokey, contaminated air and particularly the noxious and lethal gases contained therein. Smoke mask 10 includes a main body or hood 12 having a front 12*a*, a top 12*b*, and a back 12*c* that encloses an interior area 16. A head opening 14 leads into the interior area 16 of the hood 12 and is sized to allow a user to position smoke mask 10 over his or her head.

The hood 12 of smoke mask 10 is constructed from a suitable material such as a fire retardant polyvinyl chloride (PVC) that is pliable and flexible. One such material is known by the trademark "WEBLON." Constructing the main body 12 from a pliable and flexible material allows the mask 10 to be both easily stored and placed over a person's head.

Front 12*a* of main body 12 has a transparent vinyl panel 20 formed therein. The transparent panel 20 is disposed adjacent the person's eye when mask 10 is placed about his or her head so that the wearer's vision is not blocked.

A filter pack 22 is also located on the front 12*a* and filters air passing from the outside of the mask to the interior area 16 of the mask 10. The contaminated air is filtered by the filter pack 22 to provide a safe air supply for the wearer. A one-way check valve 24 is also disposed on front 12*a* of main body 12. Check valve 24 functions in a conventional manner to allow air to pass from the interior area 16 of the mask 10 to an outside area and checks or prevents contaminated air from passing into the interior area 16 of main body 12 via the check valve 24. A particular advantage of the check valve 24 is that it preserves the life expectancy of the filter by not requiring the mask to refilter the previously inhaled air when the air is exhaled.

A seal strap 30 is fixed to main body 12 and used to seal mask 10 about a wearer's face. Seal strap 30 includes opposed ends 30*a* and 30*b* and a stretchable main section 30*c* extending therebetween. Opposed ends 30a and 30*b* are attached on opposite sides of front 12*a* of the mask 10. The seal strap 30 can be moved between a non-sealed position (FIG. 1) and a sealed position (FIG. 2). In the non-sealed position, the stretchable main section 30*c* stretches across the front 12*a* of main body 12 and above the transparent panel 20. In the sealed position, the stretchable main section 30*c* extends along opposite sides of front 12*a* and extends below and around the chin of the wearer.

Figure 3:
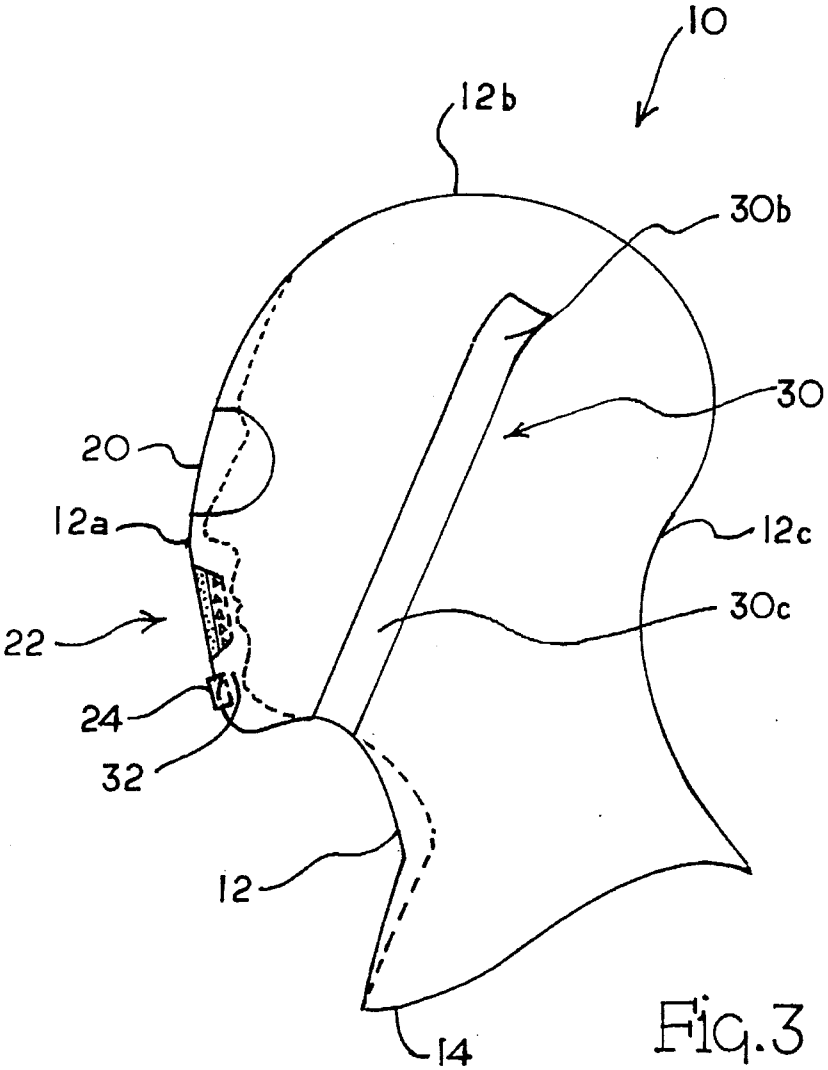
FIG. 3 is a side elevational view of the smoke mask of the present invention showing the mask with the chin strap pulled downwardly underneath the chin of the individual wearing the mask.

Seal strap 30 is designed to form a seal that extends along both sides of the wearer's face, under the wearer's chin, and across the wearer's forehead so that the face of the wearer is totally sealed by the mask 10. When the mask 10 is placed in the sealed position, an interior sealed area 32 is formed between the wearer's face and main body 12 (FIG. 3).

Now turning to a discussion of the filter pack 22, filter pack 22 includes several different layers or stages for filtering contaminated air. A particulate layer 40 forms the outermost layer of filter pack 22 and is used to filter particulate matter contained in contaminated air in a conventional manner. Positioned adjacent particulate layer 40 is a carbon-monoxide catalyst layer 46. The carbon-monoxide catalyst layer 46 converts carbon monoxide into carbon dioxide as contaminated air passes through the filter pack 22. An example of a material that will serve as a carbon-monoxide catalyst is HOPCALITE®. The final filter stage for the filter pack 22 is disposed on the interior side of the filter pack is an activated carbon layer indicated by the numeral 42. The activated carbon layer 42 absorbs and removes gases from the contaminated air. There is provided a barrier 44 that extends between the carbon-monoxide catalyst layer 46 and the activated carbon layer 42.

Figure 4:
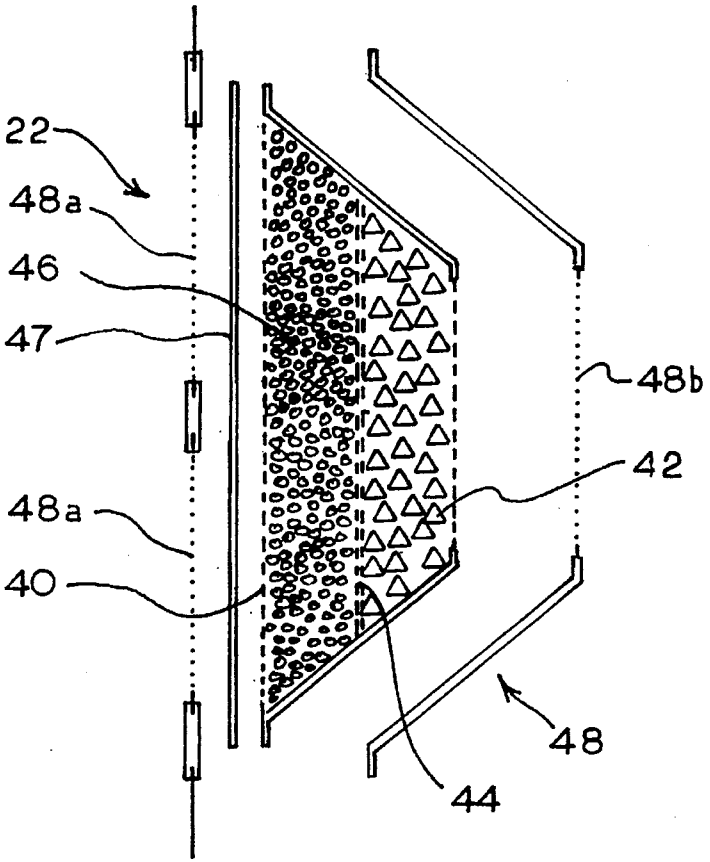
FIG. 4 is an exploded cross-sectional view of a portion of the smoke mask and particularly illustrates the three-stage filter disposed in the front portion of the face mask.

The filter layers 40–46 are enclosed in a heat-sealed filter housing 48. Filter housing 48 includes front openings 48*a* that allow contaminated air to enter into filter pack 22 and rear openings 48*b* that allow the filtered air to pass into the interior sealed area 32 of mask 10 for the wearer to breath. It should be appreciated that the filter pack 22 shown in FIG. 4 is shown in the form of an exploded view. It is noted that the filter housing 48 includes front and rear portions that are shown separated from each other. However, as pointed out above, when secured within the smoke mask, the entire housing 48 is secured by a heat-sealing process such that the housing 48 encloses and supports the various layers of the filter pack 22. A polypropylene sheet 47 is interposed between the particulate filter 40 and the back of the front portion of the housing 48. The polypropylene sheet 47 helps bind the filter housing and insures an effective and efficient encapsulation of the respective filter layers that comprise the filter pack 22. It is appreciated that the polypropylene sheet 47 would be permeable in order that air could pass therethrough.

Figure 1:
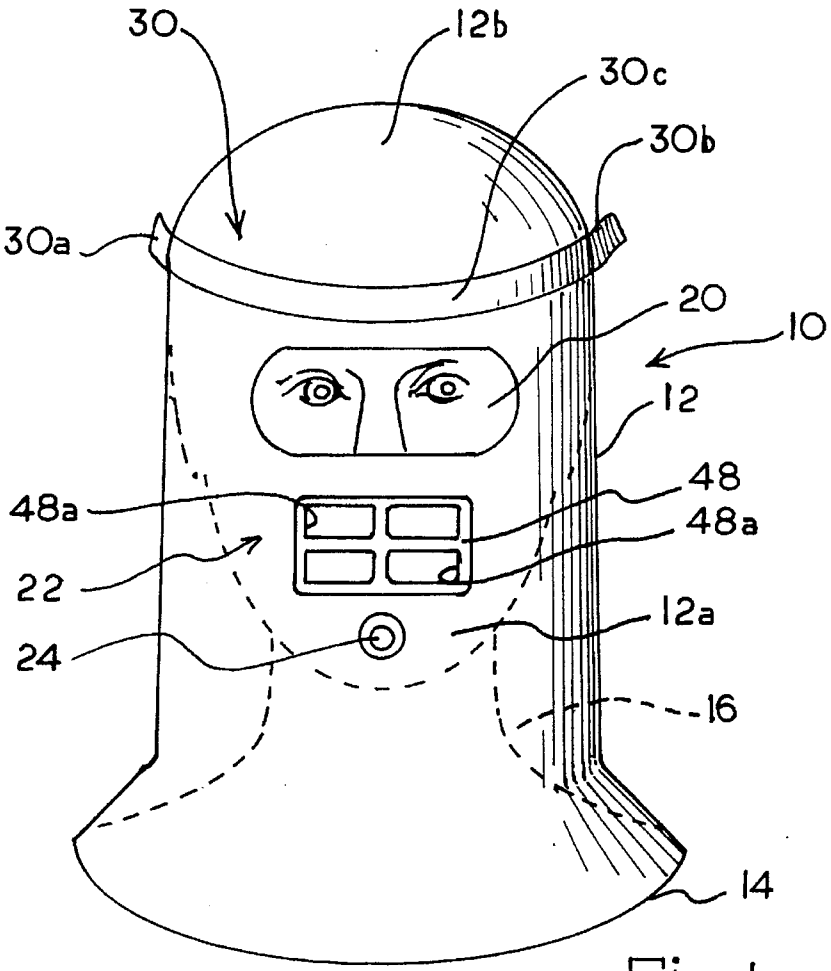
FIG. 1 is a front elevational view of the smoke mask of the present invention disposed over the head of a person but with the chin strap of the hood extending in an unstretched mode across the forehead of the person.

It should be pointed out that smoke mask 10 is designed to be both disposable and economicable so that it would be feasible to provide a mask for each person in a home or in a high-rise office or apartment building. To use a mask 10, a user places hood 12 over his or her head as shown in FIG. 1. The head opening 14 and interior area 16 of hood 12 are sized so that the mask can be easily placed over the user's head. Unlike prior art disposable masks, hood 12 does not have to be stretched and pulled over the user's head. As shown in FIGS. 1 and 2, hood 12 is sized so that it can be worn without clinging to the user's face. Because the mask is sized to be freely positioned over the user's head and face, a user should have less apprehension in placing the mask over his or her head. In addition, the mask is more comfortable to wear and is easily positioned about the head of the user.

The mask 10 initially assumes an unsealed position when placed about the user's head. In the unsealed position, the seal strap 30 is in an unstretched position and extends across front 12*a* and above transparent panel 20 along the forehead of the wearer.

To place mask 10 in the sealed position in order to protect one from contaminated air, the user pulls the main section 30*c* of seal strap 30 downwardly to position the main section 30*c* so that it extends and is secured below the person's chin. As shown in FIGS. 2 and 3, the seal strap 30 extends downwardly along opposite sides of the person's face and underneath the chin of the user. It should be particularly appreciated that the mask of the present invention can be easily applied especially during a crisis.

When placed in the sealed position, the seal strap 30 functions to seal hood 12 about the user's face to form an interior sealed area 32. In particular, a seal is formed along the seal strap 30 extending downwardly along opposite sides of the user's face and extending below the user's chin. The seal strap 30 also pulls hood 12 downwardly so that top 12*b* of hood 12 is pressed against the user's head so that a continuous seal is formed around the user's face.

When in the sealed positioned, air can only pass into the interior sealed area 32 through filter pack 22. Contaminated air is drawn into filter pack 22 when the person inhales. The contaminated air passing through filter pack 22 initially passes through particulate layer 40 which removes particulate from the contaminated air. The contaminated air is then drawn through the carbon-monoxide catalyst layer 46 which converts carbon monoxide to carbon dioxide. The partially filtered air is lastly drawn through the activated carbon layer 42 where harmful and noxious gaseous are absorbed. The filtered air is then passed through rear openings 48*b* of filter housing 48 to provide a safe air supply to the person. Exhaled air passes through the one-way check valve 24 in a conventional manner. By utilizing the check valve, the life of the filter is extended since the exhaled air is not required to be refiltered during exhaling.

The filter pack 22 is designed to operate and provide a safe supply of air to the wearer for an extended period of time. In particular, the activated carbon layer 42 is formed from a solid bed of carbon that remains effective for a extended period of time.

As described above, it is seen that mask 10 provides an economical and easy-to-use mask. The seal strap 30 allows the mask to be sized so that it can be easily and comfortably placed over the user's head. In addition, the three-stage filter pack 22 is designed to more effectively remove harmful and noxious gases and to last for an extended period of time. Finally, the mask of the present invention can easily and comfortably accommodate prescription glasses.

Now, turning to FIGS. 5–8, a second embodiment for the smoke mask of the present invention is shown therein. The smoke mask 10 of the second embodiment includes the same basic pullover hood-type structure shown in FIGS. 1 and 2. The basic differences between this second embodiment and the embodiment disclosed in FIGS. 1–4, is that the second embodiment includes a different multi-stage filter pack 22 and further includes a new elastic strapping arrangement for creating a seal around the face of a person wearing the smoke mask 10 of the present invention.

Figure 5:
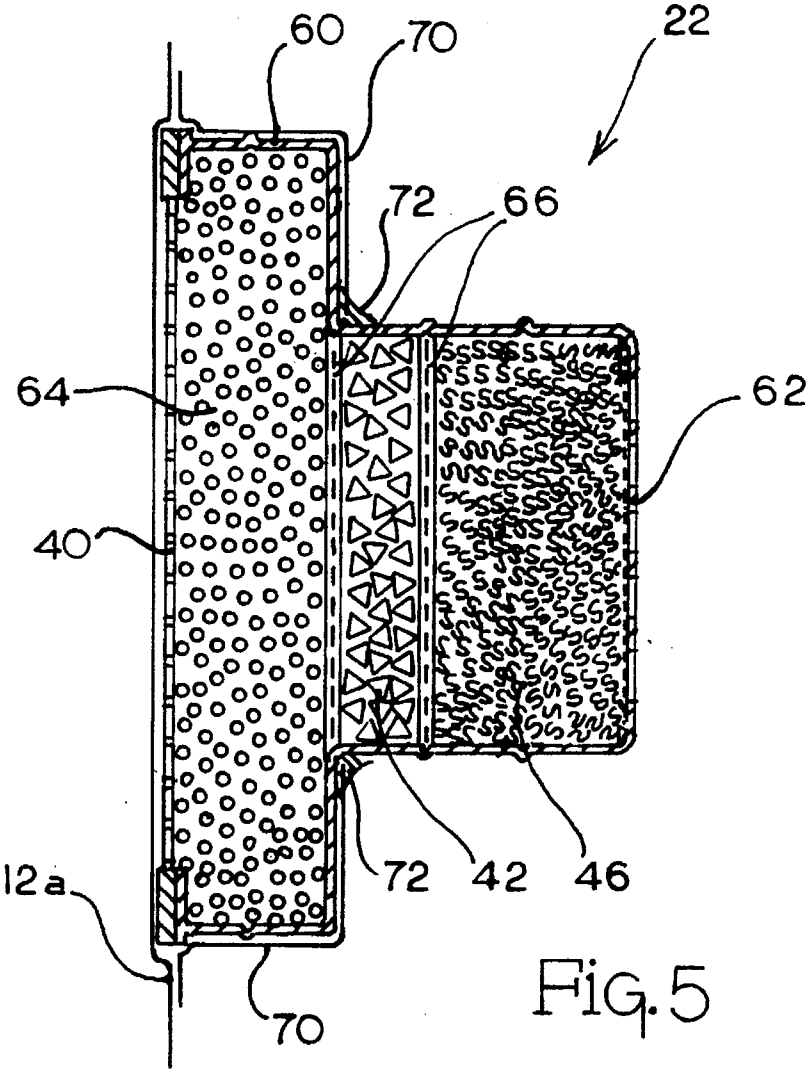
FIG. 5 is a cross-sectional view of a multi-stage filter pack for a second embodiment of the smoke mask of the present invention.
Figure 8:
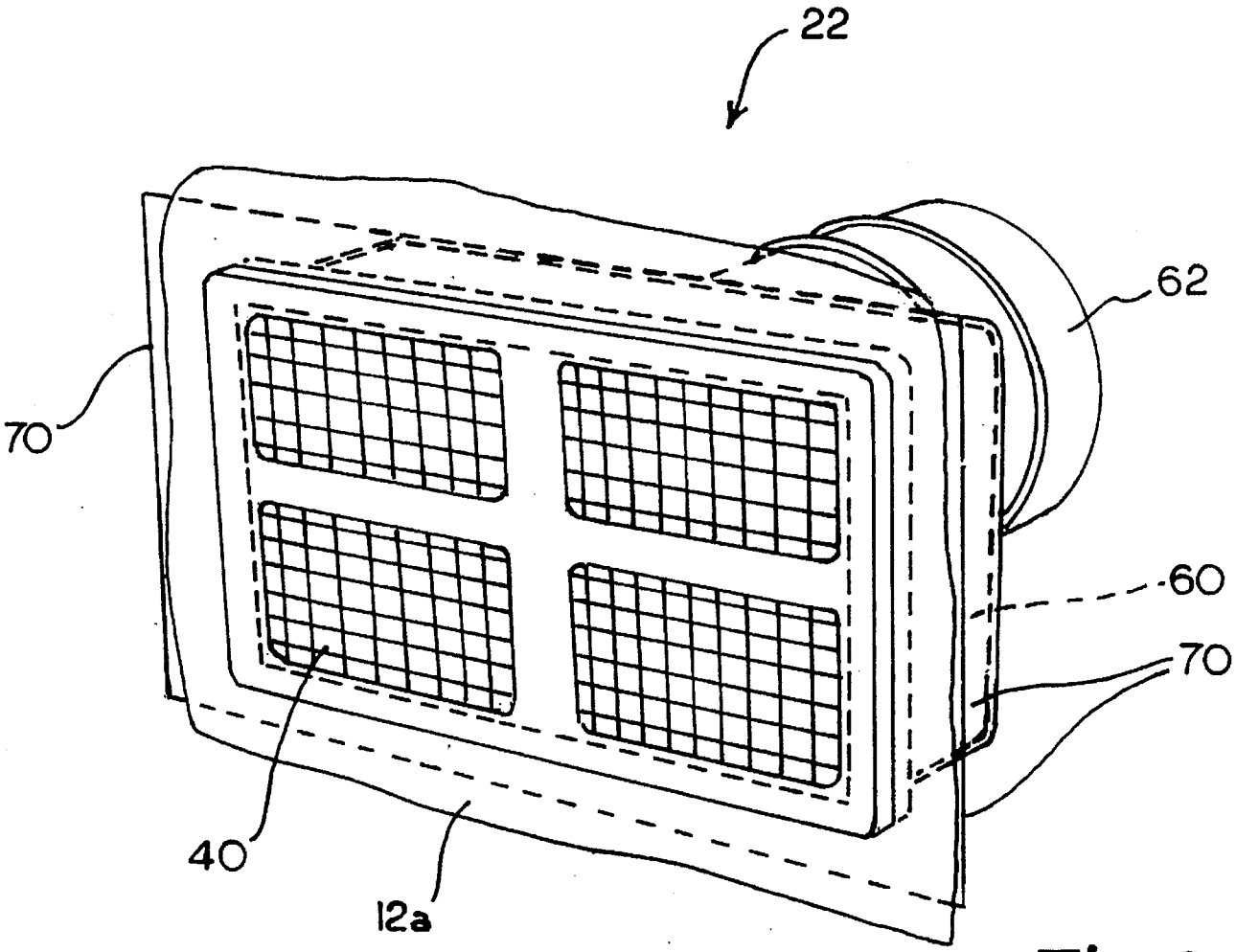
FIG. 8 is a fragmentary perspective view showing the multi-stage filter pack secured within the smoke mask.

First, turning to the multi-stage filter pack 22, it is seen that the same is shown in FIGS. 5 and 8. The multi-stage filter pack 22 shown in FIG. 5 includes a first generally rectangular or square section 60. Integrally formed with the first section 60 is a rear section 62. The rear section 62 is generally cylindrical and the effective flow area through the rear section 62 is less than the flow area of the first section 60. As will be appreciated from subsequent portions of this disclosure, the contaminated air and smoke will enter the first section 60 and pass through a series of filter layers. Once the contaminated air being treated exits the first section 60, the air will move inwardly in a converging fashion so as to pass through the rear section 62 which has a smaller cross-sectional area than the first section 60. The rear section includes openings through which the purified or clean air exists.

Disposed in the front or first section 60 of the filter pack 22 is two separate and distinct filter layers. These two filter layers include a particulate filter 40 and a desiccant layer 64. Both filter layers 40 and 64 are housed within the front or first section 60 of the filter pack 22.

Disposed in the rear circular section 62 is two separate and distinct filter layers. Disposed in the front or initial portion of the rear section 62 is an activated carbon layer 42. As seen in the drawings, the activated carbon layer 42 is disposed adjacent the desiccant layer 64. However, there is an air permeable separator 66 (e.g. spun bonded non-woven polyester separator) interposed between the desiccant layer 64 and the activated carbon layer 42. Disposed behind the activated carbon layer 42 is a fourth filter layer which is referred to as the carbon monoxide catalyst filter 46. It is appreciated that another air permeable separator 66 is interposed between the activated carbon layer 42 and the carbon monoxide catalyst layer 46.

Continuing to refer to the multi-stage filter pack 22 of the second embodiment, it is seen that the first layer of the filter pack is in fact the particulate layer 40. That is, the contaminated air and smoke entering the smoke mask first passes through the particulate layer 40. Disposed immediately adjacent the particulate layer 40 is the desiccant layer 64. Desiccant layer 64 functions to remove dampness and moisture from the contaminated air and smoke in order that it can be more effectively and efficiently treated during downstream treatment. Those skilled in the art will appreciate that various types of desiccant media would be suitable for use in this type of application. It has been found that a desiccant media known by the trade name "Molecular Seive" would be both appropriate and suitable for this application. The effective area of flow through the layers 40 and 64 is generally equal as each of the layers extend from side to side throughout the front or first section 60 of the filter pack 22.

Disposed in the rear section 62 is the activated carbon filter layer 42 and the carbon monoxide catalyst layer 46. Note that in a preferred embodiment, the carbon monoxide catalyst layer 46 includes a depth or thickness greater than the thickness of any one of the other filter layers disposed within the filter pack 22. In fact, as shown in FIG. 5, the carbon monoxide catalyst layer 46 in that design illustrated is approximately twice as thick as the activated carbon layer 42. Also, it is appreciated that the carbon monoxide catalyst layer 46 is thicker than the desiccant layer 64. This, of course, enables there to be more extensive and intimate contact between the contaminant air passing through the filter pack 22 and the carbon monoxide catalyst media 46. Also, it is appreciated that because of the cross-section area differential existing between the front section 60 and the rear section 62 of the filter pack, the contaminated air passing through the filter pack has a greater opportunity to become exposed to the carbon monoxide catalyst media 46. This, of course, increases the overall efficiency of the carbon monoxide catalyst layer 46.

The design of the filter pack 22 allows for the substantial reduction of carbon monoxide levels present in the contaminated air. In particular, it is desirable, and in some cases standards require, that an incoming air sample that includes 1,000 ppm carbon monoxide at a flow rate of 32 liters per minute be reduced by the filter media to 300 ppm carbon monoxide for a ten minute period of use. The design disclosed herein will meet that standard.

In order to secure the filter pack 22 within the hood-type smoke mask 10, the side and back areas of the front section 60 is encapsulated in a plastic covering 70. The plastic covering 70 is in turn fused or otherwise secured to the hood or mask material which in a preferred embodiment would be made of vinyl. Note in FIG. 5 where the plastic encapsulating material 70 is actually fused with a front portion **12*a* of the smoke mask. To securely seal the encapsulating plastic material 70 about the front section 60, there is provided a circular seal 72 that permanently seals the encapsulating material 70 around the front portion of the cylindrical rear section 62 at its juncture with the front section 60 (FIG. 5). Therefore, it is appreciated that air being induced into the front of the filter pack 22 is prevented from escaping by passing between the sides of the front portion 60 and the encapsulating plastic material 70. The presence of the circular seal 72 that is permanently bonded around the front of the rear section 62 prevents air from escaping from the confines of the encapsulating plastic material 70**.

Figure 7:
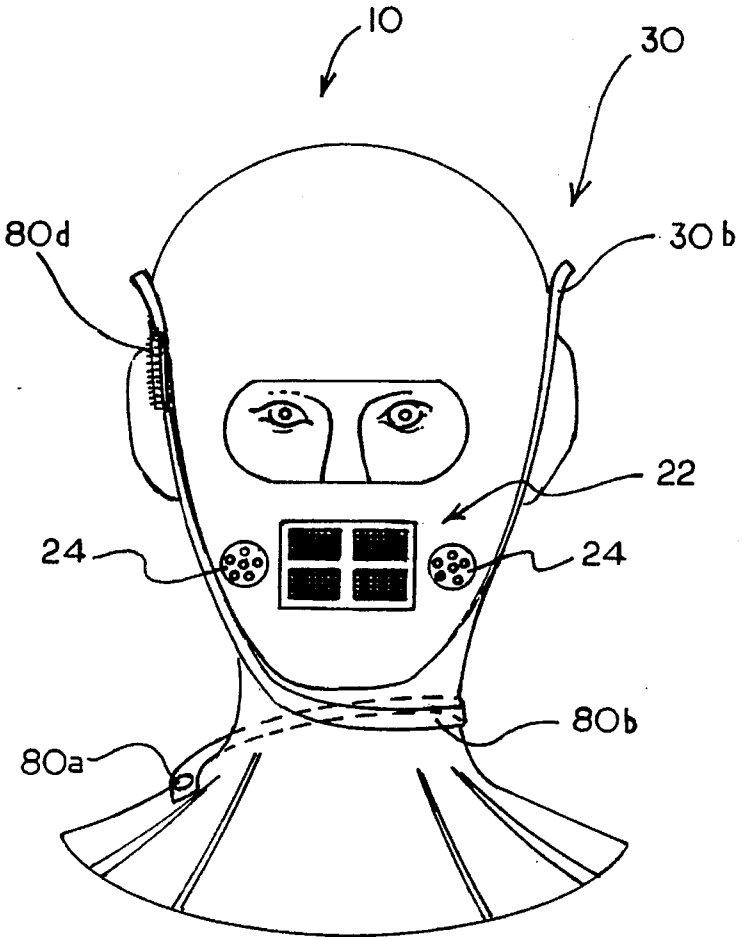
FIG. 7 is a front elevational view of the second embodiment of the smoke mask showing the cooperating straps in a sealed mode.
Figure 6:
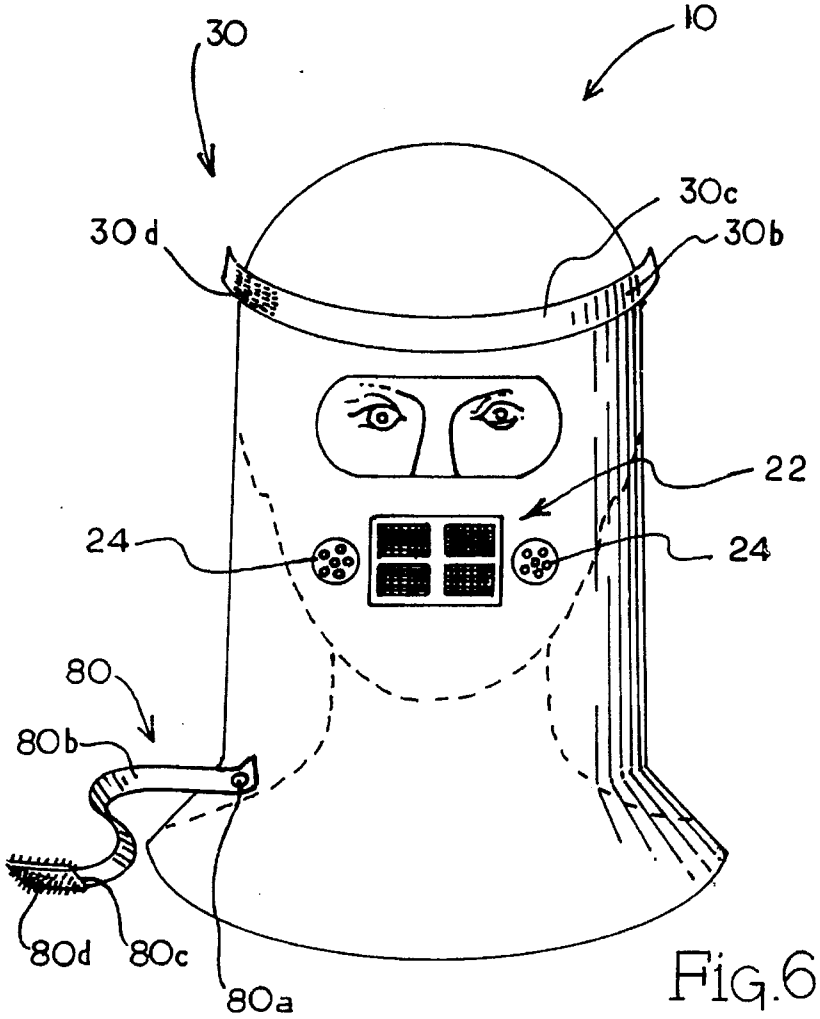
FIG. 6 is a front elevational view of the second embodiment of the smoke mask of the present invention showing the cooperating straps for sealing the mask in a nonsealed mode.

Now turning to FIGS. 6 and 7, there is shown therein a different sealing arrangement for creating a sealed relationship between the smoke mask 10 and the face of a person wearing the same. In this second embodiment, the smoke mask includes the same forehead seal strap indicated generally by the numeral 30. However, on one outer side of the strap 30 there is provided a fastener patch **30*d*. The fastener patch 30**d would preferably be one mating part of a hook and eyelet-type fastener arrangement.

For use in conjunction with the forehead seal strap 30, the design of the second embodiment incorporates an elastic wrap-around strap indicated generally by the numeral 80. Wrap-around strap includes an anchor end **80*a*, an intermediate portion 80*b*, a terminal end 80*c*, and a fastener patch 80*d*, formed on the terminal end 80*c*. Again, the fastener patch 80*d*** disclosed herein would be one part of a conventional hook and eyelet-type fastener arrangement.

In FIG. 7, both straps 30 and 80 are shown in their unattached positions. In FIG. 7, the respective straps 30 and 80 are shown in a sealed and an attached position. Note that the forehead elastic strap 30 in FIG. 7 is disposed in the same general position discussed in the first embodiment and shown in FIG. 2. That is, the forehead elastic strap 30 is pulled down under the chin such that the strap extends downwardly from one side of the forehead, down along one side of the face, underneath the chin, and back up the opposite side of the face to where the forehead strap terminates and is secured to the opposite side of the forehead. Note in FIG. 7, that the fastener patch **30*d* associated with the forehead strap 30 is disposed about the right temple area of the person wearing the mask 10. This forms at least a partial seal along the line of the forehead strap 30** as it extends around a substantial portion of the face of the person wearing the mask.

To complete the seal, the wrap-around strap 80 is essentially wound around the head and neck of the subject and extended back up one side of the face where the wraparound strap 80 connects to the fastener patch **30*d* of the forehead strap 30. In particular, as illustrated in FIG. 7, the wrap-around strap 80 is stretched from its anchor point 80*a* and pulled from one side of the mask around and behind the neck area of the person wearing the mask. At all times, the straps are disposed exteriorly of the smoke mask 10. The wrap-around strap 80 is pulled and stretched and wound around the back of the neck and on around the side of the neck and then underneath the chin area of the person. Here, the wrap-around strap 80 and the forehead strap extend either in close proximity to one another or they can overlap. However, the wrap-around strap 80 is continued to be pulled and stretched up the side of the person's face adjacent to the original anchor point of the wrap-around strap 80. Finally, the fastener patch 80*d* formed on the terminal end 80*c* of the wrap-around strap 80 is actually secured to the fastener patch 30*d* of the forehead strap 30. This arrangement tends to create an additional seal around a substantial neck portion of the smoke mask 10 and that seal in conjunction with the seal created by the forehead strap 30 form a direct seal around a substantial portion of the subject's face. It is obviously important to form a relatively airtight seal at least around the mouth, nose and eye area of the subject wearing the mask. The wrap-around strap 80** is again of particular advantage inasmuch as it seals a substantial portion of the neck area of the mask around the subject's neck so as to create a relatively airtight seal around the neck.

It should be appreciated that the wrap-around strap 80 is designed to seal around the face and the natural bone structure of the subject's head. This is to be contrasted with other hood-type devices that have attempted to seal directly around the neck. The cooperating straps 30 and 80 lend themselves to a more universal fit in that one size hood and strap arrangement will accomodate small, medium and large size heads.

Also, it is appreciated that the smoke mask shown in FIGS. 6 and 7, include two one-way check valves 24 that help to expel carbon dioxide that tends to accumulate inside the mask. Also, the two one-way check valves tend to reduce internal fogging.

Finally, the filter pack 22 is designed to provide an effective filtering device but at an economical cost. More particularly, the filter pack is designed to maximize residency time of the contaminated air as it passes through the filter pack 22 while at the same time the filter pack is designed such that it can be economically manufactured.

The mask of the present invention has a wide range of applications and can be used in situations other than fire and smoke: Basically, the mask of the present invention can be used in any environment or any situation where personal protection is required. For example, in applying pesticides in a garden or field crop, the mask of the present invention can be utilized to protect those persons. Further, the mask of the present invention can be used in industrial applications of all types including cases where there has been mild hazardous spills and where cleanup is involved. By the same token, the mask of the present invention can be utilized in chemical industries or where caustic substances are used and where employee evacuation is required for their safety.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A disposable smoke mask for filtering contaminated air comprising:

(a) a slip over main body head covering including a head opening and an interior area sized and adapted to accommodate the head of a wearer, the main body head covering having a front portion that is adapted to extend, when donned from the forehead of a wearer to an area below the chin of a wearer so as to cover substantially all of the face of a wearer;

(b) a one-way valve formed in the main body head covering, said one-way valve passing air from the interior area of the main body head covering to an exterior area outside of the head covering;

(c) a four-stage filter pack formed in the main body head covering for filtering air passing from the exterior area to the interior area of the head covering, the four-stage filter pack including four separate and distinct stages and including:

(1) a first outer particulate layer said particulate layer removing particulate from contaminated air being induced by inhalation through the filter pack into the head covering;

(2) a desiccant layer disposed adjacent the particulate layer and removing moisture from the air passing through the filter pack;

(3) an activated carbon layer disposed adjacent the desiccant layer and downstream therefrom, said activated carbon layer absorbing and removing gas from the contaminated air; and (4) a carbon monoxide catalyst layer disposed adjacent the activated carbon layer and downstream from the activated carbon layer said carbon monoxide catalyst layer converting carbon monoxide into carbon dioxide, said filter pack constraining incoming contaminated air to move through the particulate layer first and thereafter through the desiccant layer and then through the activated carbon layer and finally through the carbon monoxide catalyst layer; and (d) a cooperating dual strap combination for sealing the head covering around the face of the wearer, the duel strap combination including a first elastic forehead strap secured to opposite sides of the mask and normally assuming an unsealed position when the strap extends across the area of the head covering overlying the forehead of the wearer, the forehead elastic strap being attached at opposite points to the head covering and being stretchable to a sealed position where the elastic forehead strap extends downwardly and under the chin of the wearer, and wherein the duel strap combination includes a second wrap-around strap secured to a bottom area of the head covering and in a sealed position the wrap-around strap extends around a back area of the wearer's neck engaging the head covering in the process and continues to extend around the side of the neck and back under the chin of the wearer and thereafter the wrap-around strap extends up one side of the face of the wearer and attaches to a portion of the forehead strap, whereby the forehead and wrap-around straps cooperate to form a complete sealed area between the wearer's face and the head covering.

2. The disposable smoke mask of claim 1 wherein the four-stage filter pack is configured such that the effective cross-sectional flow area of the carbon monoxide catalyst layer is reduced relative to at least one other layer of the filter pack but wherein the depth of the carbon monoxide catalyst layer is deeper than any one of the other three layers that comprise the four-stage filter pack.

3. The disposable smoke mask of claim 1 wherein the respective layers that form the filter pack are separated by a spun bonded non-woven polyester divider.

4. The disposable smoke mask of claim 1 wherein the head covering is formed substantially from a fire retardant polyvinyl chloride material.

5. The disposable smoke mask of claim 1 wherein the filter pack includes a front portion and wherein there is provided a plastic encapsulating material that is secured to and bonded around the front portion of the filter pack, and wherein the plastic encapsulating material is in turn secured to the head cover and effectively secure the filter pack to the head cover.

6. The disposable smoke mask of claim 5 wherein the plastic encapsulating material is secured to the head covering through a heat fusion process that forms a heat seal connecting seam between the plastic encapsulating material and the head covering.

7. The disposable smoke mask of claim 5 wherein the filter pack includes a front section and rear section and wherein there is provided a surrounding seal at the juncture of the front and rear sections which effectively seals the plastic encapsulating material to the filter pack and prevents air from escaping from an area that lies between the filter pack and the encapsulating plastic material.

8. The disposable smoke mask of claim 1 wherein the filter pack includes a front section and downstream rear section with the downstream rear section being smaller in cross-sectional area than the front section and wherein the front section includes the particulate and desiccant filter layers while the activated carbon filter layer and carbon monoxide catalyst layer are housed in the downstream rear section of the filter pack.

9. The disposable smoke mask of claim 8 wherein the thickness of the carbon monoxide catalyst layer within the filter pack is greater than the thickness of any single filter layer housed within the filter pack.

10. A hood-type smoke mask for filtering contaminated air comprising:

(a) a hood-type pullover head covering for enclosing the head of a person and extending downwardly adjacent and around the neck area of the person;

(b) a multi-stage filter! assembly formed in the hood-type head covering and that filters contaminated air that is induced into the head covering by inhalation; and (c) a cooperating duel elastic strap arrangement for sealing a facial area about the head such that contaminated air may not gain access to the person's facial area except by passing through the multi-stage filter assembly, the duel elastic cooperating straps including:

(1) an elastic forehead strap secured to opposite sides of the hood and in a non-sealed mode extends across the area of the hood adapted to overlie the forehead of a person wearing the hood, and wherein the elastic forehead strap is stretchable to a sealed position where the same extends downwardly and under the chin of the person wearing the hood; and (2) a wrap-around elastic strap secured to a bottom area of the hood and in an unattached and non-sealed mode having a remote free end, and wherein the wrap-around elastic strap in a sealed mode extends around a lower back area of the hood and around the back of the neck of the person wearing the hood and then around and underneath the chin area of the person wearing the hood and then upwardly along one side of the hood and the face of the wearer where the wrap-around elastic strap attaches and forms a generally air-tight seal around the facial area of the person wearing the pullover hood.

11. The smoke mask of claim 10 where in the forehead strap and the wraparound strap include cooperating attaching fasteners and when in the sealed and attached mode the wrap-around elastic strap attaches to the forehead elastic strap.

12. The smoke mask of claim 10 wherein the multi-stage filter assembly includes four distinct filter layers including:

(1) a particulate layer;

(2) a desiccant layer;

(3) an activated carbon layer; and (4) a carbon monoxide catalyst layer.

13. The smoke mask of claim 10 wherein the multi-stage filter assembly includes a housing structure having front openings, contaminated air entering the filter assembly through said front openings and rear openings, filtered air passing into the interior area of the smoke mask through said rear openings.

14. A method of protecting a person from smoke and contaminated air via a hood-type smoke mask having a multi-stage filter pack formed therein comprising the steps of:

(a) pulling a hood-type smoke mask downwardly over a person's head and extending the smoke mask such that it extends around the neck area of the person;

(b) forming a seal around the face of the person by pressing the smoke mask against the head and forming a relatively air-tight seal around a selected facial area that includes at least the mouth and nose so as to isolate that area of the face;

(c) the step of forming a seal the face including pulling an elastic forehead strap downwardly along opposite sides of the face and extending the forehead strap around and under the chin, the elastic forehead strap in this attached position extends from a side point over the forehead downwardly adjacent to one side of the face, underneath the chin, and back up the other side of the face; and (d) the step of forming a seal further including extending an elastic wrap-around strap from a lower portion of the smoke mask around the back area of the person's neck and continuing to encircle the neck by extending the wrap-around elastic strap around and under the chin and then up one side of the face where a terminal end of the wrap-around strap is secured to the smoke mask such that the two straps, the forehead elastic strap and the wrap around elastic strap, cooperate to securely seal the smoke mask about the person's face.

15. The method of claim 14 including the step of filtering contaminated air through the multi-stage filter pack associated with the smoke mask and including the step of inducing and drawing contaminated air through a series of separate and distinct layers including a particulate filter layer, a desiccant filter layer, an activated carbon layer filter, and a carbon monoxide catalyst layer.

16. The method of claim 15 including the step of first directing the contaminated air through the particulate filter layer and thereafter directing the contaminated air through the desiccant filter layer and thereafter directing the contaminated air through the activated carbon filter layer and the carbon monoxide catalyst filter layer.

17. The method of claim 16 further including the step of exhausting air from the interior of the hood-type smoke mask by directing exhaust air out at least one, one-way check valve.

* * * * *